United States Patent [19]

Akerblom et al.

[11] Patent Number: 4,973,000

[45] Date of Patent: Nov. 27, 1990

[54] METHOD AND APPARATUS FOR DETERMINING THE CONTACT POSITION IN A REFINER

[75] Inventors: Bengt O. Åkerblom, Huddinge; Bengt O. Löfqvist, Johanneshov, both of Sweden

[73] Assignee: Sunds Defibrator Industries Aktiebolag, Sweden

[21] Appl. No.: 460,187

[22] PCT Filed: Sep. 8, 1988

[86] PCT No.: PCT/SE88/00459

§ 371 Date: Feb. 6, 1990

§ 102(e) Date: Feb. 6, 1990

[87] PCT Pub. No.: WO89/02783

PCT Pub. Date: Apr. 6, 1989

[30] Foreign Application Priority Data

Sep. 29, 1987 [SE] Sweden ..... 8703745

[51] Int. Cl.[5] ..... B02C 25/00

[52] U.S. Cl. ..... 241/30; 241/37; 241/101.3

[58] Field of Search ..... 356/375; 241/33, 37, 241/30, 259.1, 259.2, 259.3, 34, 101.3

[56] References Cited

U.S. PATENT DOCUMENTS

| | | | |
|---|---|---|---|
| 4,148,439 | 4/1979 | Floden | 241/34 X |
| 4,441,817 | 4/1984 | Pryor | 356/375 |
| 4,627,578 | 12/1986 | Whyte | 241/34 X |

FOREIGN PATENT DOCUMENTS

| | | | |
|---|---|---|---|
| 1105604 | 7/1981 | Canada | 241/37 |
| 2923507 | 1/1980 | Fed. Rep. of Germany | 241/37 |

*Primary Examiner*—Mark Rosenbaum

*Attorney, Agent, or Firm*—Lerner, David, Littenberg, Krumholz & Mentlik

[57] ABSTRACT

Methods for determining the contact position between a pair of relatively rotating refining surfaces are disclosed including detecting the heat radiating from the initial contact between the pair of refining surfaces during relative rotation therebetween in order to generate an output signal and utilizing the output signal to determine the contact position. Apparatus for determining the contact position is also disclosed.

10 Claims, 2 Drawing Sheets

FIG. 2
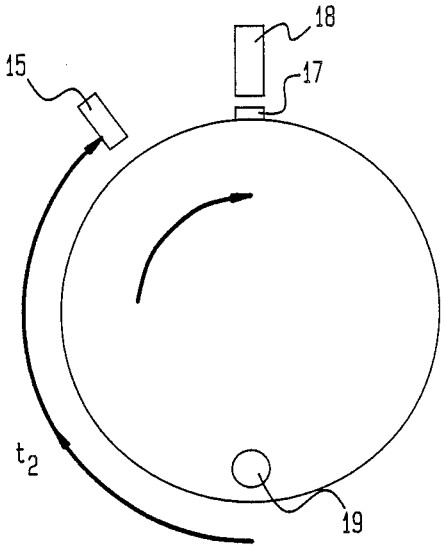
FIG. 3
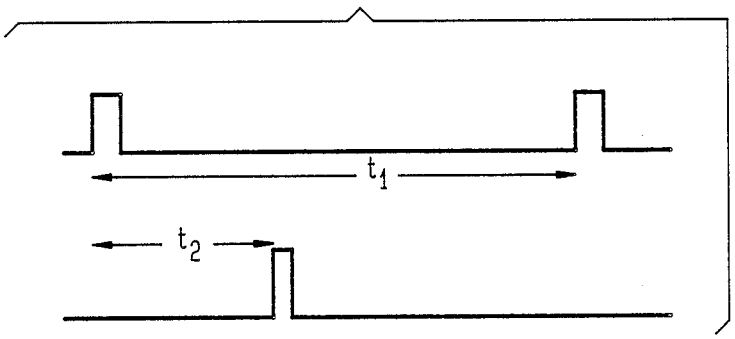
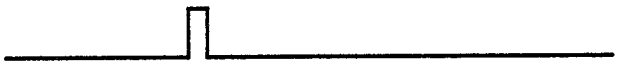
FIG. 4
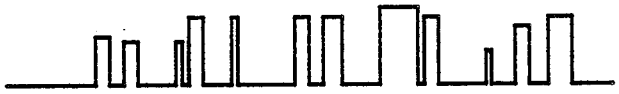
FIG. 5

METHOD AND APPARATUS FOR DETERMINING THE CONTACT POSITION IN A REFINER

FIELD OF THE INVENTION

The present invention relates to a method and an apparatus for determining the contact position for the refining surfaces on two opposed refining discs rotating relative to one another in a disc refiner. Determination or indication of this position thus takes place when the gap between the refining surfaces is zero.

BACKGROUND OF THE INVENTION

A disc refiner generally comprises two opposed refining discs, which are provided with exchangeable refining elements which constitute the refining surfaces of the refiner. In disc refiners in which wood chips are to be refined into paper-making pulp, the refining is carried out between the two refining discs, which are thus kept at a definite distance from each other. Depending on the type of refiner being utilized, one or both of the refining discs are mounted on a rotary axle. These axles are driven by motors which are intended to rapidly rotate the refining discs, and the distance between the refining discs (gap) is adjusted by means of hydraulics, and is measured by means of specialized measuring systems. Due to faulty functioning during operation, the refining surfaces may contact each other. If this occurs, breakdown may result, or in any event, the refining surfaces will be subjected to considerable wear, which can significantly reduce the operating time for these refiners. It is, therefore, very important to accurately control the gap between the refining discs.

In order to accurately measure the distance between the refining surfaces, measuring systems have been employed which require preliminary adjustment of the zero point; for example, immediately after the refining elements have been exchanged or replaced. In order to so determine the zero point of the measuring system, it is important that the contact position be determined. It has been known that the contact position can be detected by utilizing sound measuring apparatus. This method requires that a transmitter be mounted on one of the two refining surfaces. When the refining surfaces then contact each other, vibrations are propagated through the refining disc to the transmitter, which can constitute a microphone, impact pulsometer or vibrometer.

One disadvantage of this method is that the transmitter also measures other sources of interference, such as the axle bearings. It is therefore difficult to detect a slight contact, and it is necessary for the signal to "drown" out other sources of interference. This technique is also incapable of measuring or determining the phase position of the contact point, i.e., the point or location where the refining surfaces first come in contact with each other. Another disadvantage of these techniques is that they presume that one of the two refining surfaces is stationary. Therefore, there are no present day methods for detecting the contact point in the case of a pair of rotating refining surfaces.

SUMMARY OF THE INVENTION

In accordance with the present invention these and other disadvantages have now been overcome by applicants' discovery of a method for determining the contact position between a pair of relatively rotating refining surfaces which comprises detecting the heat radiating from the initial contact between the pair of refining surfaces during their relative rotation so as to generate an output signal and utilizing that output signal to determine the contact position. In accordance with a preferred embodiment of the method of the present invention, the method includes determining the amplitude and pulse width of the output signal so that the magnitude of the heat radiating from contacting can be calculated.

In accordance with another embodiment of the method of the present invention, the method includes determining the rotation frequency of a pair of relatively rotating refining surfaces, utilizing the output signal to determine the contact position comprising synchronizing the output signal to the rotation frequency for the purpose of determining the position of the contact point on the refining surfaces.

In accordance with another embodiment of the method of the present invention, the method includes determining the pulse width of the output signal and utilizing the output signal to determine the contact position by utilizing the pulse width of the output signal to measure the parallelity of the pair of refining surfaces.

In accordance with a preferred embodiment of the method of the present invention, the method includes visually and audibly determining the output signal.

In accordance with another aspect of the present invention, apparatus is provided for determining the contact position between a pair of relatively rotating refining surfaces comprises heat radiation detecting means for detecting the heat radiation generated by the contact between the pair of relatively rotating refining surfaces from a position radially displaced from the pair of refining surfaces.

In a preferred embodiment the pair of relatively rotating refining surfaces are enclosed in a refiner housing and the heat radiation detecting means is mounted in the refiner housing. In a highly preferred embodiment, the heat radiation detecting means is located outside of the refiner housing and the apparatus includes coupling means for coupling the heat radiation detecting means to the refiner housing for transmitting the detected heat thereto.

In another embodiment of the apparatus of the present invention the apparatus includes amplifier means for visually and audibly presenting the output signal.

In a general sense the present invention employs heat radiation from the contact of refining surfaces for the purpose of determining the axial contact position.

BRIEF DESCRIPTION OF THE DRAWINGS

The present invention is described in considerable detail in the following detailed description, in which reference is made to the accompanying Figures, as follows:

FIG. 2 is a schematic representation of the method and apparatus of the present invention;

FIG. 3 is a schematic representation of a portion of the output signal from the transmitter signal used in accordance with the present invention;

FIG. 4 is a schematic representation of another portion of the output signal from the transmitter signal used in accordance with the present invention; and FIG. 5 is a schematic representation of another portion of the output signal from the transmitter signal used in accordance with the present invention.

DETAILED DESCRIPTION

Figure 1:
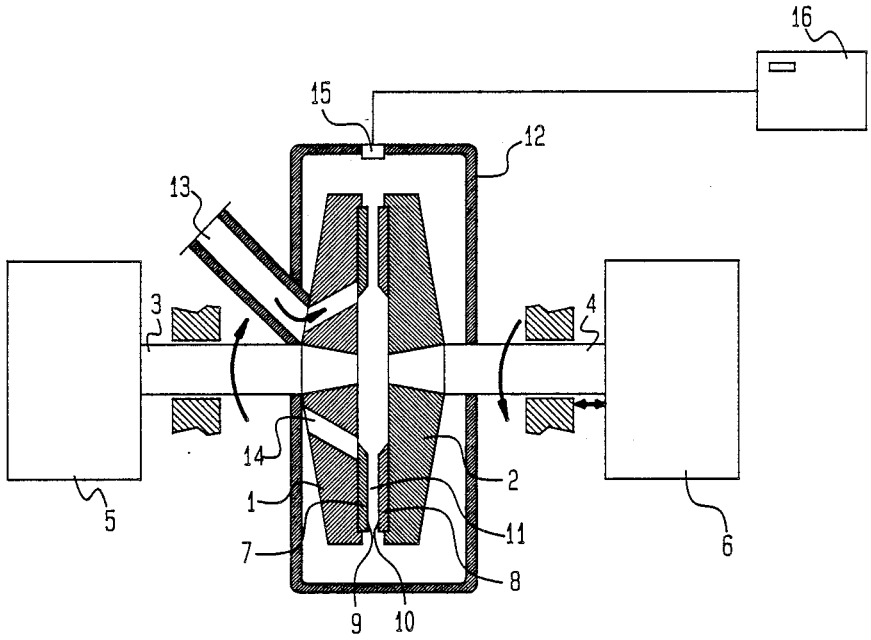
FIG. 1 is a side, elevational, partially sectional, partially schematic representation of one embodiment of the apparatus of the present invention.

Referring first to FIG. 1, there is shown a disc refiner including two refining discs, 1 and 2, which are arranged on two axles, 3 and 4, which can rotate in opposite directions. The axles are driven by motors, 5 and 6, and one of the axles, 4, is also axially movable. The refining discs are provided with exchangeable refining elements, 7 and 8. The refining surfaces, 9 and 10, of the refining elements, 7 and 8, define a gap, 11. The refiner discs, 1 and 2, are enclosed by a refiner housing, 12. Chips are supplied through an infeeder, 13, and through openings, 14, in one of the refining discs, 1. A transmitter, 15, which is sensitive to heat radiation, such as a so-called photo-detector, is provided for the purpose of detecting the frictional heat radiation which is generated when the refining surfaces, 9 and 10, contact each other. The transmitter itself can be positioned in the refiner housing, 12, at a location radially outside the gap, 11. The transmitter is directed to the outermost edges of the refining surfaces, 9 and 10, because the refining elements, 7 and 8, are designed so that the distance between the refining surfaces, 9 and 10, will be smallest at the periphery.

Since the temperature within the refiner housing, 12, can potentially become quite high, it may in some cases be advantageous to position the transmitter at a location spaced from the refiner housing. The transmitter can then be coupled to a special conducting device which is connected to the refiner housing, 12, radially outside the refining discs, 1 and 2. This conducting device can, for example, be a fiber optic cable, which thus conducts the radiation from the place of detection to the transmitter.

When during their rotation the refining discs, 1 and 2, approach each other, so that the refining surfaces, 9 and 10, eventually come into actual contact with each other, the temperature increases, and heat energy is generated at the point where that contact takes place. This rise in temperature is detected in the form of heat radiation by the transmitter, 15. It is, thus, not the absolute temperature, but only the rise in temperature which is detected. The transmitter then emits an electric output signal, which can be utilized for the purpose of determining the contact position. Due to the rotation of the refining discs, the output signal of the transmitter will have the same frequency as the rotation frequency. The amplitude and pulse width of the signal are proportional to the heat radiation. Since there are no other heat radiating objects, the sensitivity of the transmitter can be adjusted so that a very slight contact can be detected thereby.

When the axles of the refiner are not correctly aligned, the parallelity of the refining surfaces, 9 and 10, is affected. Therefore, only a portion of the periphery of the refining surfaces initially comes into direct contact. The phase position and extension of the contact point are thus a measure of the parallelity between the refining surfaces.

By synchronizing the output signal to the rotation frequency of the axle, and thus of the refining disc itself, the phase position of the contact point of the refining surfaces can be determined. In addition, the pulse width of the output signal provides a basis for determination of the extension of the contact point. It is therefore possible to utilize the output signal in order to measure the alignment of the refining discs, and thus of the axles.

The transmitter can also be coupled to an amplifier 16 in which the output signal is presented both visually and audibly for the purpose of calibrating the measuring system being utilized. Example One of the axles in the disc refiner shown in FIG. 2 is provided with a mechanical flag, 17, so that during rotation of the axle this provides impulses to a second transmitter, 18. Thus, the second transmitter, 18, creates pulses which are synchronized with the number of revolutions, and which are repeated with a time period $t_1$. At a nominal rotation of 1500 rpm, the time period is 40 ms.

The transmitter, 15, which is sensitive to heat radiation, is located peripherally offset in relation to the second transmitter, 18. In FIG. 2 the locations of these two transmitters, 15 and 18, are shown schematically. The heat radiation from the contact point, 19, on the refining surface will be detected by the transmitter, 15, after the time $t_2$ when the contact point has rotated up to the transmitter, 15. By studying the displacement of the signal pulses from the two transmitters, 15 and 18 (see FIG. 3), it is possible to determine the phase position of the contact point.

Depending on the peripheral extension of the contact between the refiner surfaces, the shape of the output signal varies. FIG. 4 shows an output signal which can be regarded in an oscilloscope. The amplitude of the pulse depends on how hard the contact is, and the width of the pulse depends on the extension of the contact. FIG. 5 shows the signal from a hard contact from many different points. Thus, the output signals are indications of the parallelity between the refining discs, and thus of the alignment of the axles.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for determining the contact position between a pair of relatively rotating refining surfaces comprising detecting the heat radiating from the initial contact between said pair of refining surfaces during said relative rotation so as to generate an output signal and utilizing said output signal to determine said contact position.

2. The method of claim 1 including determining the amplitude and pulse width of said output signal whereby the magnitude of said heat radiating from said contacting can be calculated.

3. The method of claim 1 including determining the rotation frequency of said pair of relatively rotating refining surfaces, said utilizing of said output signal to determine said contact position comprising synchronizing said output signal to said rotation frequency for the purpose of determining said contact position on said refining surfaces.

4. The method of claim 1 including determining the pulse width of said signal, said utilizing of said output signal to determine said contact position comprising utilizing said pulse width of said output signal for measuring the parallelity of said pair of refining surfaces.

5. The method of claim 1 including visually and audibly determining said output signal.

6. Apparatus for determining the contact position between a pair of relatively rotating refining surfaces enclosed in a refiner housing comprising heat radiation detecting means for detecting the heat radiation generated by contact between said pair of relatively rotating refining surfaces from a position radially displaced from said pair of refining surfaces, said heat radiation detecting means being mounted in said refiner housing.

7. The apparatus of claim 6, wherein a portion of said heat radiation detecting means is located outside of said refiner housing, and including coupling means for coupling said portion of said heat radiation detecting means to said refiner housing for transmitting said detected heat thereto.

8. The apparatus of claim 6 wherein said heat radiation detecting means generates an output signal, said apparatus including amplifier means for visually and audibly presenting said output signal.

9. Contact position determining apparatus comprising a pair of relatively rotating refining surfaces and heat radiation detecting means mounted at a position radially displaced from said pair of refining surfaces for detecting heat radiation generated by contact between said pair of relatively rotating refining surfaces.

10. The apparatus of claim 9 wherein said heat radiation detecting means generates an output signal and including amplifier means for visually and audibly presenting said output signal.

* * * * *

UNITED STATES PATENT AND TRADEMARK OFFICE

CERTIFICATE OF CORRECTION

PATENT NO. : 4,973,000

DATED : November 27, 1990

INVENTOR(S) : Bengt O. Åkerblom and Bengt O. Löfqvist

It is certified that error appears in the above-identified patent and that said Letters Patent is hereby corrected as shown below:

Column 4, line 65, following "said" (first occurrence), insert --output--.

Signed and Sealed this

Sixteenth Day of June, 1992

*Attest:*

DOUGLAS B. COMER

*Attesting Officer*

*Acting Commissioner of Patents and Trademarks*